US009138054B2

(12) United States Patent
Görz

(10) Patent No.: US 9,138,054 B2
(45) Date of Patent: Sep. 22, 2015

(54) HOUSEHOLD BUILT-IN APPLIANCE WITH A SPECIFIC EXTERIOR WIDTH MEASUREMENT IN THE FORM OF A NON-EVEN IMPERIAL MEASUREMENT, APPARATUS WITH A RECESS AND A PLURALITY OF BUILT-IN APPLIANCES, AND METHOD FOR FITTING BUILT-IN APPLIANCES IN A RECESS

(71) Applicant: BSH BOSCH UND SIEMENS HAUSGERÄTE GmbH, München (DE)

(72) Inventor: Alexander Görz, Aalen (DE)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/521,648

(22) Filed: Oct. 23, 2014

(65) Prior Publication Data

US 2015/0115789 A1 Apr. 30, 2015

(30) Foreign Application Priority Data

Oct. 25, 2013 (DE) ..... 10 2013 221 771

(51) Int. Cl.
*A47B 96/04* (2006.01)
*A47B 77/08* (2006.01)
*F25D 23/10* (2006.01)

(52) U.S. Cl.
CPC ..... *A47B 77/08* (2013.01); *F25D 23/10* (2013.01); *F25D 2500/02* (2013.01)

(58) Field of Classification Search
CPC ..... F25D 2500/02; F25D 23/10; F25D 23/12; F25D 23/00; A47B 77/08; F24C 15/30
USPC ..... 312/401
See application file for complete search history.

(56) References Cited

U.S. PATENT DOCUMENTS

| | | | | |
|---|---|---|---|---|
| 3,351,400 | A * | 11/1967 | Sholtes | 312/111 |
| 6,997,530 | B2 * | 2/2006 | Avendano et al. | 312/401 |
| 7,185,874 | B2 * | 3/2007 | Deiss et al. | 248/680 |
| 7,293,847 | B2 * | 11/2007 | Lee et al. | 312/406.2 |
| 7,665,810 | B2 * | 2/2010 | Crompton et al. | 312/204 |
| 8,104,143 | B2 * | 1/2012 | Heger et al. | 16/347 |
| 8,252,171 | B2 * | 8/2012 | Doran | 210/87 |
| 8,382,219 | B2 * | 2/2013 | Hottmann et al. | 312/405 |
| 2004/0041503 | A1 * | 3/2004 | Lee | 312/406 |
| 2008/0000258 | A1 * | 1/2008 | Benz et al. | 62/447 |
| 2010/0045150 | A1 * | 2/2010 | Laible et al. | 312/237 |
| 2010/0045151 | A1 * | 2/2010 | Laible et al. | 312/245 |
| 2011/0030410 | A1 * | 2/2011 | Ciyanoglu et al. | 62/331 |

* cited by examiner

*Primary Examiner* — Hanh V Tran
(74) *Attorney, Agent, or Firm* — Nixon & Vanderhye P.C.

(57) ABSTRACT

The invention relates to a household built-in appliance, which is configured to be built into a recess and has an exterior housing, the exterior housing having an exterior width, which has a non-even measurement in inches, its number before the decimal point being 17 or 23 and its portion after the decimal point being smaller than or equal to 0.5. The invention also relates to an apparatus with a recess and a plurality of built-in appliances, as well as a method for fitting built-in appliances into a recess.

10 Claims, 1 Drawing Sheet

Figure 1:
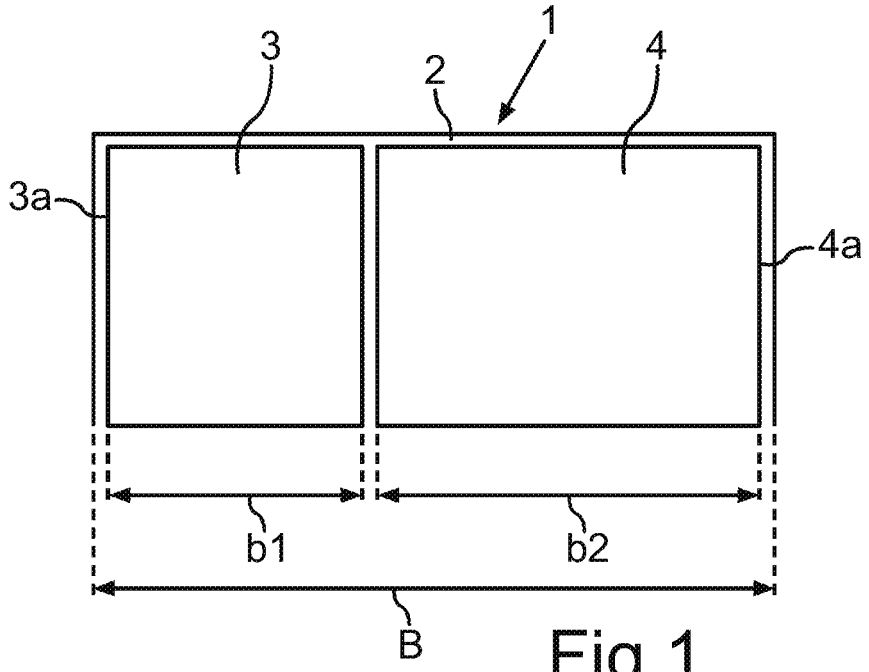

HOUSEHOLD BUILT-IN APPLIANCE WITH A SPECIFIC EXTERIOR WIDTH MEASUREMENT IN THE FORM OF A NON-EVEN IMPERIAL MEASUREMENT, APPARATUS WITH A RECESS AND A PLURALITY OF BUILT-IN APPLIANCES, AND METHOD FOR FITTING BUILT-IN APPLIANCES IN A RECESS

This application claims priority to DE Patent Application No. 10 2013 221 771.4 filed Oct. 25, 2013, the entire content of which is hereby incorporated by reference.

The invention relates to a household built-in appliance, which is configured to be built into a recess and has an exterior housing. The invention further relates to an apparatus with a recess, the width of which is configured to accommodate a plurality of built-in appliances, and a method for fitting built-in appliances in a recess.

A modular built-in refrigeration appliance platform from the applicant is known. It consists of different individual appliances. These fully integrable individual appliances are known in different appliance embodiments, for example refrigerators and freezers, which are respectively configured with or without an ice-making apparatus or an ice/water dispenser. Appliance embodiments in the form of wine bottle storage appliances or combinations of the cited appliances are also known. The different cited embodiments are also available in different appliance widths, based on imperial dimensions, which are standard for example for kitchen units in North America. The exterior measurements of these appliances of the known modular built-in household appliance platform are dimensioned in such a manner that dimensions of 18 inches (18"), 24 inches, 30 inches and 36 inches can be accommodated, it being possible to build the appliances in individually or as a combination.

In contrast to built-in refrigeration appliances of European design, these appliances are not built into a housing unit but are inserted into a gap and thus into a recess, such an operation being effected as with built-under refrigeration appliances or built-in dishwashers.

The advantage of this existing dimensional design is that consistency and flexibility are achieved in respect of planning for a kitchen fitted with built-in refrigeration appliances. In the planning phase any standard unit carcass measuring 18 inches, 24 inches, 30 inches, 36 inches can in principle be replaced by a refrigeration appliance of the modular built-in refrigeration appliance platform. The same applies to any combination of two or more such refrigeration appliances. The dimensional structure of the appliances and the connecting technology for the appliances are such that a built-in measurement with a whole number of inches always results for any arrangement and a corresponding row of unit carcasses can thus be replaced. The standard nominal 42 inch and 48 inch combinations can also be achieved by combining different individual appliances, as cited above, in a very wide range of configurations.

The dimensional design of the modular built-in refrigeration appliance platform is such that an individual appliance is a quarter of an inch narrower than the nominal measurement. A nominal 18 inch appliance of the known built-in household appliance platform therefore has actual exterior width dimensions of 17¾ inches, a nominal 24 inch appliance has actual exterior dimensions of 23¾ inches, etc. When built into a predefined recess with a whole-number opening measurement there is therefore clearance of an eighth of an inch on both sides.

The components for connecting two appliances are also configured in such a manner that there is a gap of twice one eighth of an inch and therefore a quarter of an inch between two connected appliances. This means that when individual appliances are lined up in any manner the distance to the limits of the recess is in turn always one eighth of an inch.

It is therefore possible always to use identical connecting parts and fitting parts, for example fitting parts, and also the planning principles remain consistently the same. The dimensional design of the modular built-in refrigeration appliance platform therefore offers the user a high level of flexibility and has become well established.

However it should be noted that other built-in appliances, in particular standard traditional built-in refrigeration appliances in North America, are not designed for recesses with whole-number imperial dimensions. These recesses, referred to hereafter as traditional recesses, are generally half an inch smaller than the nominal measurement. The housings of the conventional traditional appliances described are in turn a whole inch narrower than the nominal designation describes so that there is a quarter of an inch clearance on both sides. This traditional dimensional design is standard for nominal 30 inch, 36 inch, 42 inch and 48 inch appliances. However there are also instances in which two such appliances are built in next to one another, with the manufacturer stipulating recess measurements which cannot be determined simply by adding the described recess sizes. Thus the traditional US recess for two 30 inch appliances is defined as 59¾ inches. It should be noted that the nominal measurement results from the appliances generally having a frame at the front, which increases the exterior width as measured horizontally when the appliance is positioned and oriented correctly for use compared with the region in this front region of the appliance, making it wider than at a rear point or in a rear region where the actual measurement is present, when viewed in the depthwise direction.

The object of the present invention is therefore to create a household built-in appliance, an apparatus and a method for fitting built-in appliances into a specific recess, which allow a more flexible option for combing the appliances.

This object is achieved by a household built-in appliance, an apparatus and a method as claimed in the independent claims.

An inventive household built-in appliance is configured to be built into a recess and has an exterior housing. The recess is specified such that it is not a unit providing housing at the sides, top and bottom but forms a gap, into which the built-in appliance can be inserted.

It is an important concept of the invention that the exterior housing of the household built-in appliance has an actual (and therefore not nominal) exterior width as measured horizontally when the appliance is positioned and oriented correctly for use, said exterior width having a non-even measurement in inches, its number before the decimal point being 17 or 23 and its portion after the decimal point being smaller than or equal to 0.5. An embodiment of a household built-in appliance with such a specifically dimensioned width allows the best possible utilization of the entire width and therefore full occupation of the recess apart from the necessary (e.g. for ventilation and/or fitting access) air gaps between, for example, the edges and the wall of said recess even with conventional traditional recesses, in which one or more known built-in household appliances of an appliance platform are accommodated. When conventional traditional appliances in such a traditional recess are to be moved or replaced, the installation of an inventive household built-in appliance allows full utilization of the available recess width.

In combination with other conventional appliances from the modular built-in appliance platform this allows a module-type structure of an entire line of appliances in a recess, it being possible for these to be built individually and with a very close fit into said recess.

A particular advantage of this inventive household built-in appliance is that these specific exterior widths allow a combination of existing built-in household appliances of the known modular platform with a nominal width of 18 inches and 24 inches, so that a modular built-in appliance platform in particular results, the appliances of which can also be built into the traditional and standard US recesses cited above, thereby allowing maximum utilization of the width of said traditional recesses to be achieved apart from the required gap measurements. Also all the connecting and fitting parts of the appliance platform can still be used without having to be changed.

In particular US recesses of nominal width 42 inches and 48 inches can therefore be occupied extensively and to a maximum, so that the individual replacement of appliances or the retrofitting of such a traditional recess line with corresponding appliances is also possible here. Such an embodiment of an, as it were, single individual household built-in appliance means that it is no longer necessary to provide an entire appliance platform with individual width dimensions and in very different configurations in respect of its embodiments and the plurality of options. It is thus possible for the entire appliance platform with its appliances to remain identical in width and for any composition of built-in household appliances of conventional exterior width to be achieved with just a single specific household built-in appliance, as defined by the invention, in order to comply with the respective specific measurements of the traditional North American recesses, in particular 42 inches and 48 inches.

Modularity and combination options are very diverse in this context.

However if the individual appliances available until now were also offered in different widths for each appliance platform, this would involve major development outlay and would mean an impossibly large number of appliance variations. A further disadvantage of such an embodiment and procedure would be that the connecting parts and fitting parts would then have to be configured individually in a different manner, it would not be possible to have units fronts of the same width in each individual instance and the combining system of the appliance arrangement would no longer function consistently.

The invention will counteract all the cited disadvantages in the simplest manner, thereby achieving a plurality of important advantages. Of course the household built-in appliance can also otherwise be fitted individually in a freestanding manner or can be positioned in an individual manner for the user, in some instances also further from other appliances.

Provision is preferably made for the actual exterior width to be between 17.1 inches and 17.4 inches, in particular 17.25 inches. In an alternative embodiment provision is made for the actual exterior width to be between 23.1 inches and 23.4 inches, in particular 23.25 inches. These are particularly advantageous measurements, which reinforce the advantages cited above.

Provision is preferably made for the household built-in appliance to be a household refrigeration appliance. In particular it is a refrigerator.

The existing modular built-in appliance platform includes appliances categorized under the nominal measurement of 18 inches in the form of a freezer, a freezer with an ice-maker, a freezer with an ice and water dispenser and a wine bottle storage appliance. The appliances with the nominal exterior measurement of 24 inches include a freezer, a freezer with an ice-maker, a freezer with an ice and water dispenser, a wine bottle storage appliance and a refrigerator as standard-household built-in appliances.

Since of the possible combination appliances already existing in the platform only very few refrigerators are available, the embodiment of the inventive household built-in appliance as a refrigerator is particularly advantageous. It is then possible to fit a plurality of functionally useful appliance combinations very extensively in particular for the two traditional North American recess measurements of 42 inches and 48 inches with just one new appliance.

In this context a recess thus specified can therefore be fitted with a close fit with a freezer and a refrigerator or a freezer with an ice-maker and also a refrigerator or a freezer with an ice and water dispenser and also a refrigerator or a wine bottle storage appliance and also a refrigerator.

The invention also relates to an apparatus with a recess, the width of which is configured to accommodate a plurality of built-in appliances, and which has at least one first household built-in appliance configured according to the invention or an advantageous embodiment thereof, and a household built-in appliance referred to as a conventional second built-in household appliance, in particular an appliance belonging to the known modular appliance platform, in respect of its actual exterior width as measured horizontally when the appliance is positioned and oriented correctly for use.

The invention also relates to a method for fitting built-in appliances in a recess, wherein the recess is supplied with a width for accommodating a plurality of household built-in appliances and at least such a number of household built-in appliances configured as conventional built-in household appliances in respect of the exterior width as measured horizontally when the appliance is positioned and oriented correctly for use is built in that there is no space for a further conventional built-in household appliance in the remaining recess space and a first household built-in appliance configured according to the invention or an advantageous embodiment thereof is built in the remaining recess space.

The specific values of parameters for defining geometric properties cited in the documentation should also be considered to be covered by the scope of the invention in the context of deviations, for example due to manufacturing tolerances, measurement errors, system errors, DIN tolerances, etc.

Figure 2:
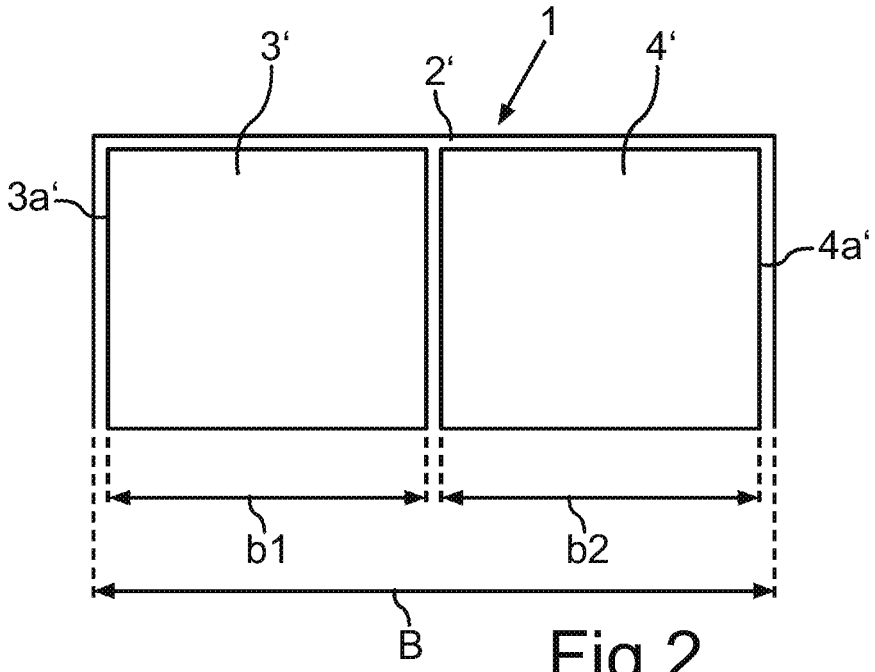

Exemplary embodiments of the invention are described in more detail below with reference to schematic drawings, in which:

FIG. 1 shows a schematic diagram of a first exemplary embodiment of an apparatus; and FIG. 2 shows a schematic diagram of a second exemplary embodiment of an inventive apparatus.

Identical elements or those of identical function are shown with identical reference characters in the figures.

FIG. 1 shows a plan view of a first exemplary embodiment of an apparatus 1, which has a recess 2 which is not a recess bordered at the periphery (top, bottom, sides) by unit elements but is a recess as cited above and defined in the introduction.

The recess 2 has an interior width dimension B, which is nominally categorized as 42 inches but is actually 41½ inches.

In the illustrated exemplary embodiment two built-in appliances are built into this recess 2, with a standard-household built-in appliance or a conventional built-in household appliance 3 of known exterior width belonging to a modular built-in appliance platform, the exterior width b1 of an exterior housing 3*a* of which is categorized as the nominal exterior width of 18 inches and is therefore actually 17.75 inches, being built in. Also arranged in this recess 2 is an exemplary embodiment of an inventive household built-in appliance 4, the exterior housing 4*a* of which has an actual exterior width b2 of 23.25 and is thus categorized with a nominal measurement of 23.5. Such an embodiment and fitting option means that a conventional traditional 42 inch recess 2, which has an actual interior measurement of 41.5 inches is occupied to the maximum and the remaining air gaps to the recess edges and between the two built-in appliances 3 and 4 are configured for standard fitting parts and the required air circulation distances and are provided in the standard manner. In particular the horizontally measured distances between the appliance exterior walls and the inner faces of the recess 2 are around ⅛ inch, in particular ⅛ inch.

FIG. 2 shows a plan view of a further exemplary embodiment of an apparatus 1. In contrast to the diagram in FIG. 1 the nominal width of the recess 2 here is categorized as 48 inches and the actual true width B is 47.5 inches.

Built into this recess 2 is a known built-in household appliance 3' with an exterior housing 3*a*', which is categorized as having a nominal width of 24 inches and has an actual true exterior measurement of 23.75.

Also built into this recess 2' is an exemplary embodiment of an inventive household built-in appliance 4' with an exterior housing 4*a*', the actual exterior width b2 of the exterior housing 4*a*' in turn being 23.5 inches and therefore being categorized as a nominal width of 23.5 inches.

It is therefore also possible to fit the recesses 2 and 2' differently and for the household built-in appliance 4 or 4' also then to be configured with a width b2 of 17.25 inches.

In both exemplary embodiments the air gaps between the exterior housings 3*a* and 4*a* and 3*a*' and 4*a*' and the limits of the recess 2 as well as the distance between the exterior housings 3*a* and 4*a* and 3*a*' and 4*a*' measure a total of 0.5 inches.

Similarly the positions of the appliances in the recess 2 and 2' can also be different, so that the appliance 4, 4' can also be arranged in the left in the views in FIGS. 1 and 2.

Provision can be made for both appliances 3 and 4 or 3' and 4' to have a shared electrical connection to link them electrically to a network connection and thus to be configured practically as a combination appliance in this respect.

LIST OF REFERENCE CHARACTERS

1 Apparatus
2, 2' Recess
3, 3' Standard household built-in appliance
3*a*, 3*a*' Exterior housing
4, 4' Household built-in appliance
4*a*, 4*a*' Exterior housing
b Width
b1 Exterior width
b2 Exterior width

The invention claimed is:

1. A household built-in appliance, which is configured to be built into a recess and has an exterior housing, wherein the exterior housing has an actual exterior width, which has a non-even measurement in inches, its number before the decimal point being 17 or 23 and its portion after the decimal point being smaller than or equal to 0.5.

2. The household built-in appliance as claimed in claim 1, wherein the exterior width is between 17.1 inches and 17.4 inches, in particular 17.25 inches.

3. The household built-in appliance as claimed in claim 1, wherein the exterior width is between 23.1 inches and 23.4 inches, in particular 23.25 inches.

4. The household built-in appliance as claimed in claim 1, wherein it is a household refrigeration appliance, in particular a refrigerator.

5. An apparatus with a recess, the actual width of which is configured to accommodate a plurality of built-in appliances and which has a first household built-in appliance configured as claimed in claim 1, and at least one second built-in household appliance that has a different actual exterior width from the first household built-in appliance.

6. The apparatus as claimed in claim 5, wherein the actual width of the recess is 41.5 inches or 47.5 inches.

7. The apparatus as claimed in claim 5, wherein the actual exterior width of the built-in household appliance has a non-even measurement in inches and the portion after the decimal point is greater than 0.5.

8. The apparatus as claimed in claim 7, wherein the actual exterior width is between 17.6 and 17.9, in particular 17.75, or between 23.6 and 23.9, in particular 23.75.

9. The apparatus as claimed in claim 5, wherein a first household built-in appliance and a second built-in household appliance have a shared electrical connection to link them to a network connection.

10. A method for fitting built-in appliances into a recess, wherein the recess is supplied with an actual width for accommodating a plurality of household built-in appliances and at least such a number of household built-in appliances configured as built-in household appliances in respect of their exterior width are built in, that there is no space for a further built-in household appliance in the remaining recess space and a first household built-in appliance configured as claimed in claim 1 is built into the remaining recess space.

* * * * *